US006622445B1

(12) United States Patent
Shillingburg et al.

(10) Patent No.: US 6,622,445 B1
(45) Date of Patent: Sep. 23, 2003

(54) MODULAR WALL BLOCK WITH MECHANICAL ANCHOR PIN

(75) Inventors: Curtis W. Shillingburg, Rock Hill, SC (US); James S. Martin, Charlotte, NC (US)

(73) Assignee: Ridgerock Retaining Walls, Inc., Charlotte, NC (US)

( * ) Notice: Subject to any disclaimer, the term of this patent is extended or adjusted under 35 U.S.C. 154(b) by 0 days.

(21) Appl. No.: 09/990,550

(22) Filed: Nov. 20, 2001

(51) Int. Cl.[7] ..... E04B 5/04

(52) U.S. Cl. ..... 52/606; 52/284; 52/285.1; 52/285.4; 52/270; 52/271; 52/589.1; 52/600; 52/608; 52/611; 52/609; 405/284; 405/286

(58) Field of Search ..... 52/606, 608, 609, 52/600, 589.1, 611, 284, 285.1, 285.4, 270, 271; 405/284, 286

(56) References Cited

U.S. PATENT DOCUMENTS

| | | | | | |
|---|---|---|---|---|---|
| 1,992,785 | A | * | 2/1935 | Steuer | 52/275 |
| 2,881,614 | A | * | 4/1959 | Preininger | 52/284 |
| 3,998,022 | A | * | 12/1976 | Muse | 52/564 |
| 4,123,881 | A | * | 11/1978 | Muse | 52/100 |
| 4,324,508 | A | * | 4/1982 | Hilfiker et al. | 405/262 |
| 4,914,876 | A | | 4/1990 | Forsberg | |
| 4,920,712 | A | * | 5/1990 | Dean, Jr. | 405/262 |
| 5,257,880 | A | * | 11/1993 | Janopaul, Jr. | 405/284 |
| 5,474,405 | A | * | 12/1995 | Anderson et al. | 405/262 |
| 5,484,235 | A | * | 1/1996 | Hilfiker et al. | 405/262 |
| 5,540,525 | A | * | 7/1996 | Miller et al. | 405/284 |
| 5,707,184 | A | * | 1/1998 | Anderson et al. | 405/262 |
| 5,735,643 | A | * | 4/1998 | Castonguay et al. | 405/284 |
| 6,019,550 | A | * | 2/2000 | Wrigley et al. | 405/262 |
| RE37,278 | E | | 7/2001 | Forsberg | |
| 6,336,773 | B1 | * | 1/2002 | Anderson et al. | 405/262 |

* cited by examiner

*Primary Examiner*—Carl D. Friedman
*Assistant Examiner*—Christy Green
(74) *Attorney, Agent, or Firm*—Schwartz Law Firm, P.C.

(57) ABSTRACT

A modular wall block is adapted for being assembled together with a number of like blocks in stacked courses to form a retaining wall. The wall block includes a front and rear, top and bottom, and opposing sides. A generally J-shaped anchor has a connecting end and an anchoring end integrally joined by a setback spacer. The connecting end is adapted for being inserted into the wall block to secure the anchor to the block. The anchoring end extends outwardly from one of the top and bottom of the wall block to engage one of the number of like blocks in an upper or lower course. The spacer locates the anchoring end a spaced distance from the rear of the block. The anchor secures the block in the retaining wall at a predetermined setback relative to like blocks in the upper or lower course.

18 Claims, 8 Drawing Sheets

MODULAR WALL BLOCK WITH MECHANICAL ANCHOR PIN

TECHNICAL FIELD AND BACKGROUND OF INVENTION

This invention relates to a modular wall block including one or more mechanical anchor pins, and a retaining wall constructed of an assembly of such blocks. The invention is particularly applicable for landscaping around residential and commercial structures to retain and preserve the surrounding soil while maintaining the aesthetics of the area. As a result of its relatively low cost, ease of manufacture, and handling, concrete masonry block has emerged as one of the most popular and widely accepted material for use in constructing retaining walls. Such blocks are generally molded.

Conventional retaining walls formed of concrete blocks are constructed in stacked courses with the ascending courses typically setback to counter the pressure of the soil acting against the wall. Mechanical means, such as geogrid mats or tie-backs, are commonly used to help stabilize the soil and further anchor the blocks in the wall. While such means are generally effective, a need exists in the industry for an improved anchoring means which mechanically interconnects the stacked block courses without interfering with placement or setback requirements, and which promotes stable and efficient construction of the retaining wall.

SUMMARY OF INVENTION

Therefore, it is an object of the invention to provide an improved wall block which uses separate mechanical means for anchoring the block in a retaining wall.

It is another object of the invention to provide a wall block which uses mechanical means for establishing the setback of the block relative to an upper or lower course of blocks.

It is another object of the invention to provide a wall block which uses mechanical means to achieve a relatively uniform and constant setback throughout curves in the retaining wall.

It is another object of the invention to provide mechanical means which anchors the blocks in the retaining wall, and which does not project into or through both of the upper and lower course blocks.

It is another object of the invention to provide mechanical means for anchoring an upper course block to adjacent lower course blocks without extending beyond the rear of the upper course block.

It is another object of the invention to provide mechanical means which connects to the upper course block and engages the rear of each adjacent lower course blocks without extending into or through the lower course blocks.

It is another object of the invention to provide mechanical means which can be readily modified to adjust the setback of the upper course block relative to the lower course blocks.

It is another object of the invention to provide a wall block which is relatively lightweight and easy to handle.

It is another object of the invention to provide a retaining wall constructed of a number of like wall blocks.

These and other objects of the present invention are achieved in the preferred embodiments disclosed below by providing a modular wall block adapted for being assembled together with a number of like blocks in stacked courses to form a retaining wall. The wall block includes a front and rear, top and bottom, and opposing sides. A generally J-shaped anchor pin has a connecting end and an anchoring end integrally joined by a setback spacer. The connecting end is adapted for being inserted into the wall block to secure the pin to the block. The anchoring end extends outwardly from one of the top and bottom of the wall block to engage one of the number of like blocks in an upper or lower course. The spacer locates the anchoring end a spaced distance from the rear of the block. The anchor pin anchors the block in the retaining wall at a predetermined setback relative to like blocks in the upper or lower course.

The term "J-shaped" is broadly defined herein to include any structure having an elongated connecting end suitable for inserting into a wall block, an elongated anchoring end extending outwardly from a top or bottom surface of the wall block, and a spacer for integrally joining the connecting end and anchoring ends together. The "J"may be inverted, or disposed at any other suitable orientation.

According to another preferred embodiment of the invention, the connecting end of the anchor pin extends perpendicular to the setback spacer.

According to another preferred embodiment of the invention, the anchoring end of the anchor pin extends perpendicular to the setback spacer.

According to another preferred embodiment of the invention, the connecting end and the anchoring end of the anchor pin extend generally parallel to each other.

According to another preferred embodiment of the invention, the anchoring end of the anchor pin is greater than twice the length of the connecting end.

According to another preferred embodiment of the invention, each of the opposing sides of the block defines a cutout and landing. An anchor hole is formed with the landing and adapted for receiving the connecting end of the anchor pin.

According to another preferred embodiment of the invention, the landing slopes from the anchor hole towards the side of the block.

According to another preferred embodiment of the invention, a setback control surface is formed with the rear of the block and cooperates with an anchor pin of an upper or lower like block to control setback of the like block when forming a radius in the retaining wall.

According to another preferred embodiment of the invention, the front, rear, and opposing sides define a hollow center portion of the wall block.

According to another preferred embodiment of the invention, the sides of the wall block taper inwardly from the front to the rear.

In another embodiment, the invention is a retaining wall constructed of a number of like, modular wall blocks assembled in stacked courses. Each of the wall blocks includes a front and rear, top and bottom, and opposing sides. A generally J-shaped anchor pin has a connecting end and an anchoring end integrally joined by a setback spacer. The connecting end is adapted for being inserted into the wall block to secure the pin to the block. The anchoring end extends outwardly from one of the top and bottom of the wall block to engage one of the number of like blocks in an upper or lower course. The spacer locates the anchoring end a spaced distance from the rear of the block. The anchor pin anchors the block in the retaining wall at a predetermined setback relative to like blocks in the upper or lower course.

In another embodiment, the invention is a modular wall block adapted for being assembled together with a number of like blocks in stacked courses to form a retaining wall. The wall block includes a front and rear, top and bottom, and opposing sides. Means extending outwardly from the wall block is adapted for engaging a like block in an upper or lower course for mechanically anchoring the wall block in position relative to the upper or lower course. A lateral tie-back channel extends from one side of the block to the other. The channel is adapted for receiving a tie-back anchor strap extending outwardly from the rear of the block and into an area of backfill to anchor the block to the backfill behind the retaining wall.

In another embodiment, the invention is a modular wall block adapted for being assembled together with a number of like blocks in stacked courses to form a retaining wall. The wall block includes a front and rear, top and bottom, and opposing sides. Means extending outwardly from the wall block is adapted for engaging a like block in an upper or lower course for mechanically anchoring the wall block in position relative to the upper or lower course. A tie-back groove is formed in the rear of the wall block and extending generally perpendicular to the front of the wall block. The groove is adapted for receiving a generally L-shaped tie-back bar extending outwardly from the rear of the block and into an area of backfill to anchor the block to the backfill behind the retaining wall.

The term "L-shaped" is defined broadly to include any structure having at least two elongated segments which extend at an angle to each other.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
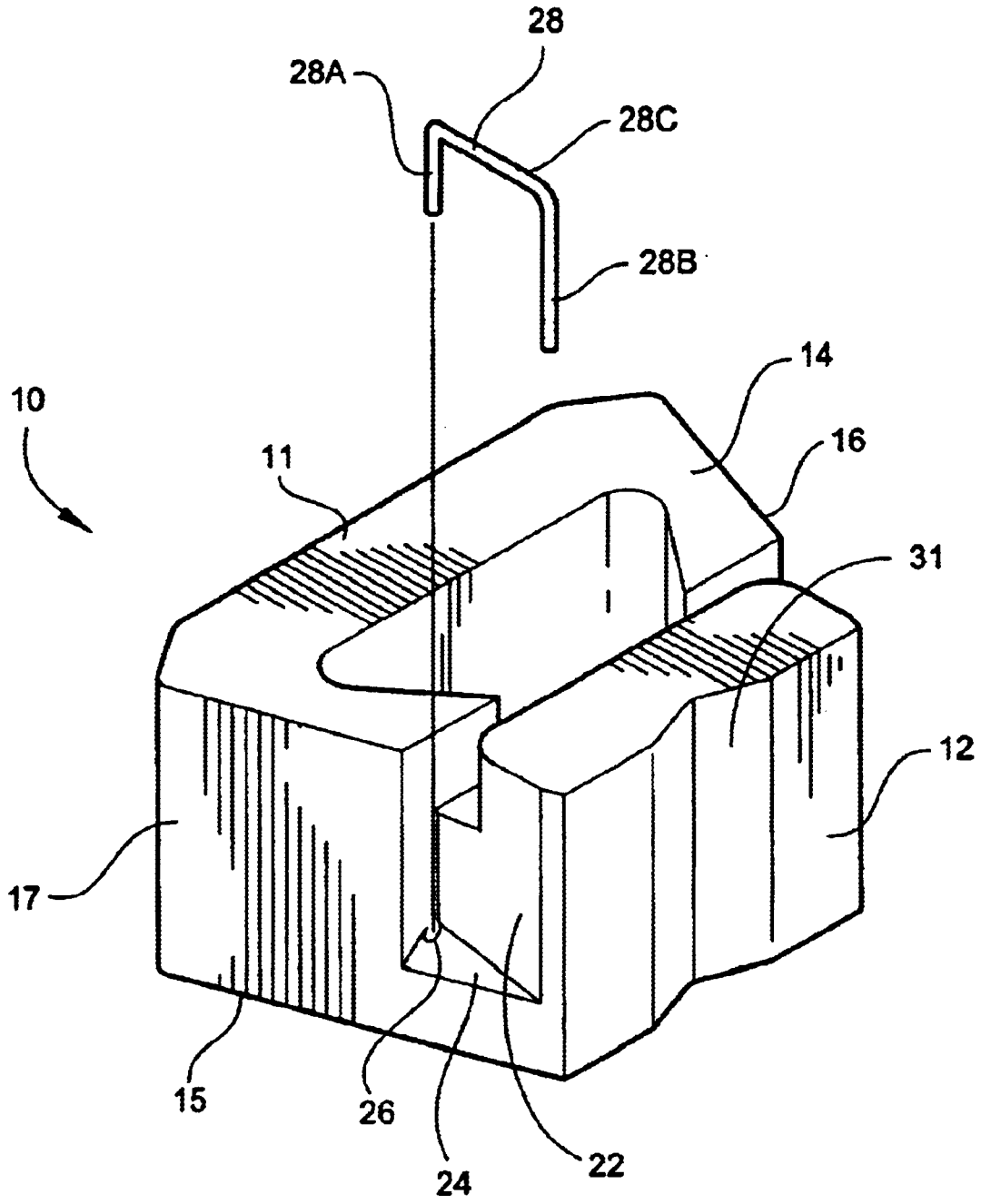
FIG. 1 is a top, rear perspective view of a wall block according to one preferred embodiment of the invention, and showing the anchor pin exploded away.
Figure 2:
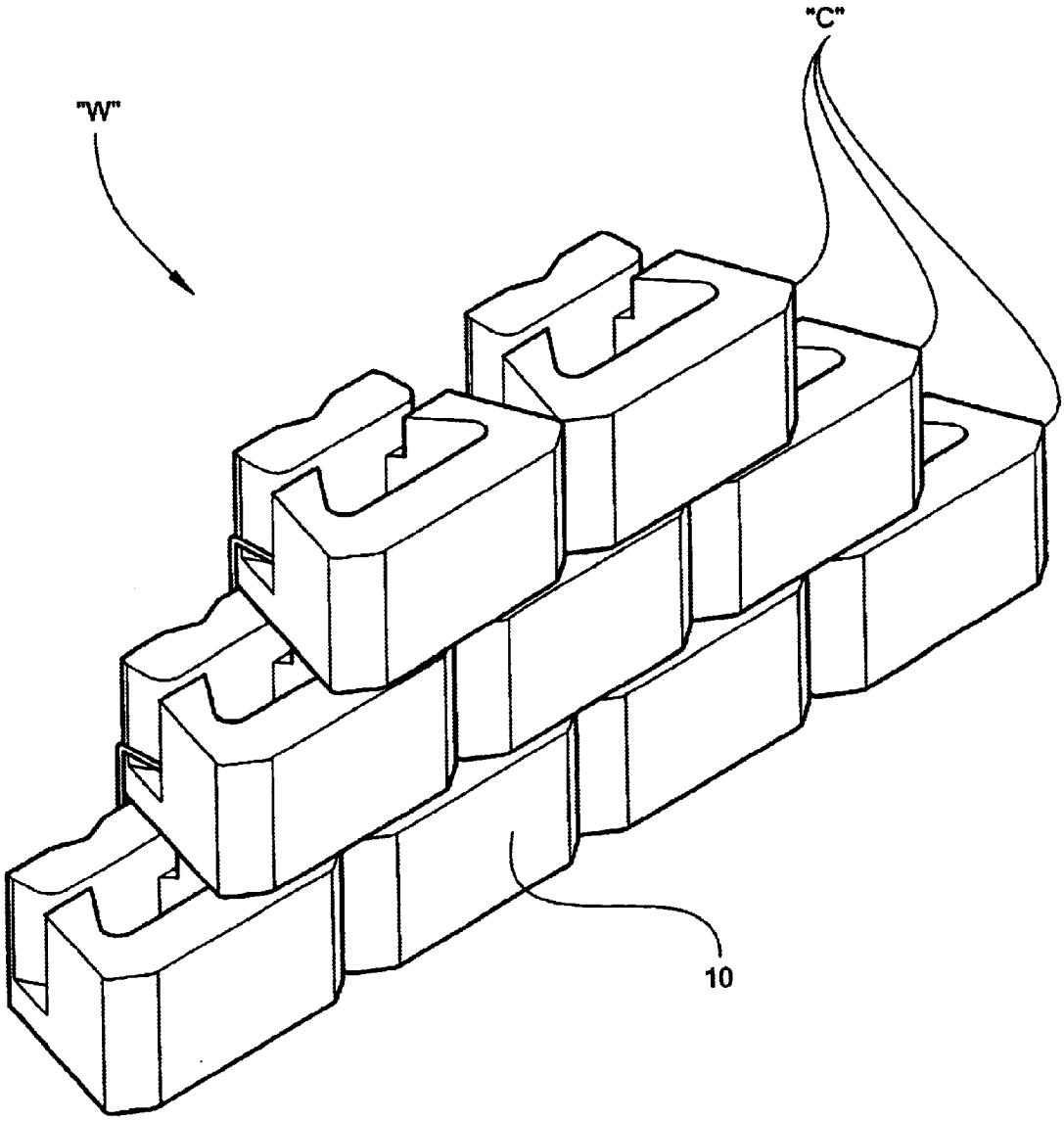
FIG. 2 is a top, front perspective view of a portion of a retaining wall constructed of a number of like wall blocks.

Referring now specifically to the drawings, a modular wall block according to the present invention is illustrated in FIG. 1, and shown generally at reference numeral 10. The wall block 10 is adapted for being assembled, as shown in FIG. 2, with a number of like blocks in stacked courses "C" to form a retaining wall "W". The wall blocks 10 are preferably formed of molded masonry concrete.

Figure 3:
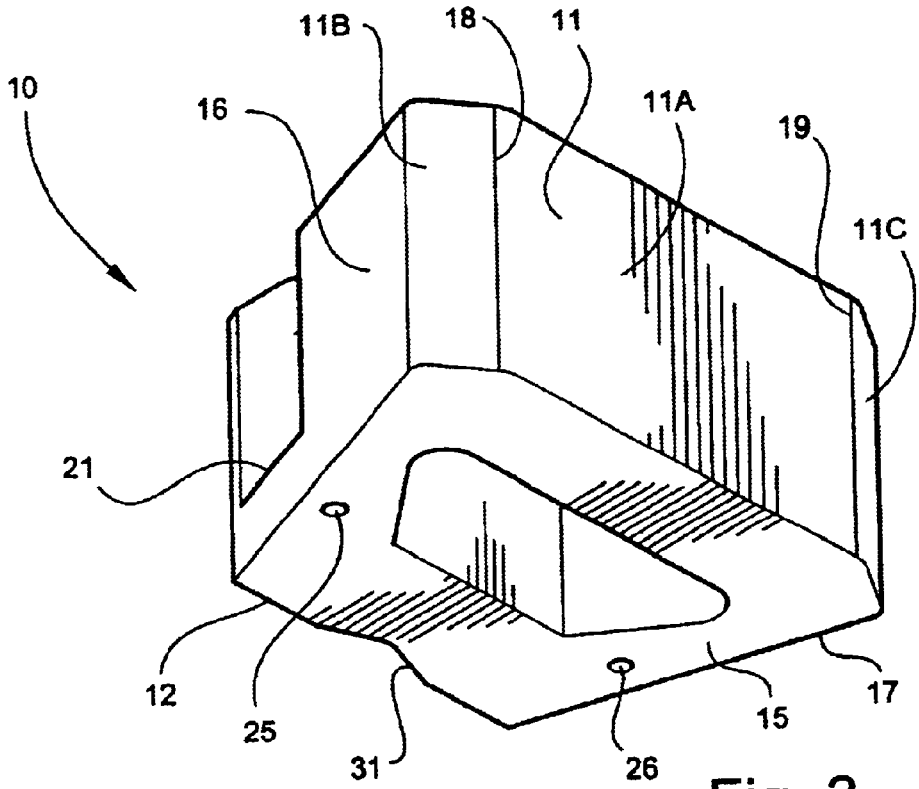
FIG. 3 is a bottom, front perspective view of the wall block with the anchor pins removed.
Figure 4:
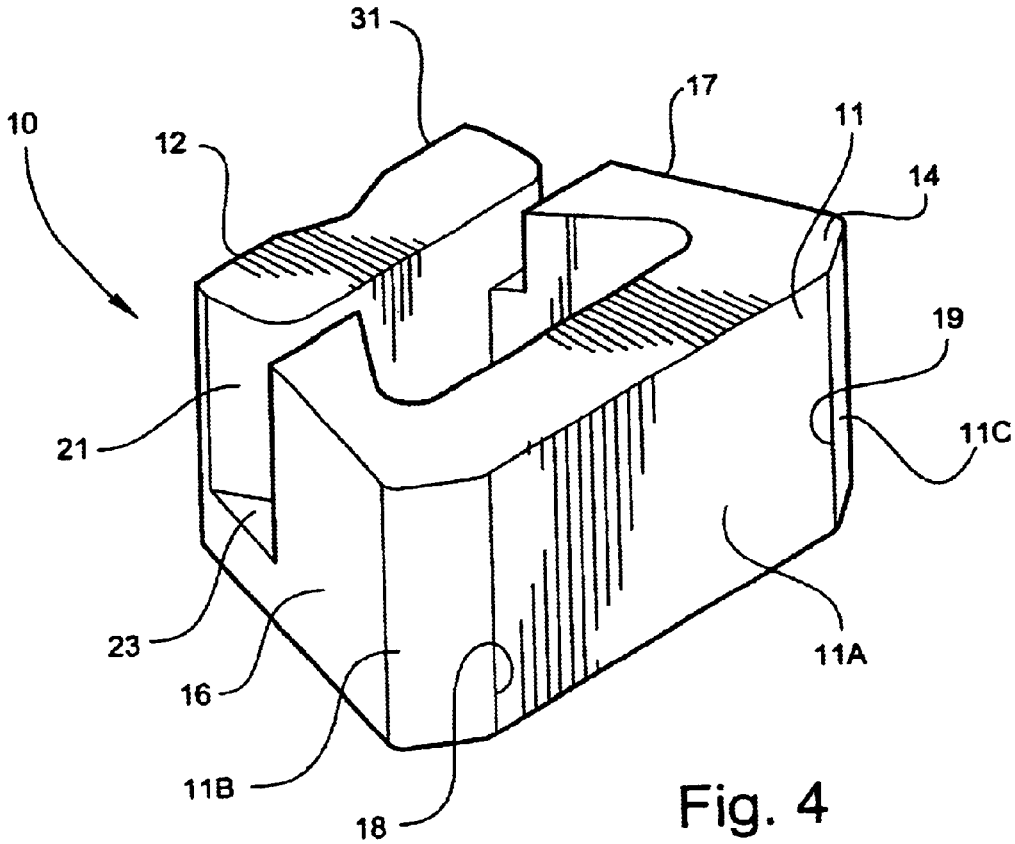
FIG. 4 is a top, front perspective view of the wall block with the anchor pins removed.

Referring to FIGS. 1, 3, and 4, the wall block 10 has a front 11 and rear 12, top 14 and bottom 15, and opposing sides 16 and 17. According to one embodiment, the front 11 includes vertical breaks 18 and 19 defining a center face portion 11A and opposing side face portions 11B and 11C. Preferably, the center face portion 11A has an unfinished, rough textured surface to promote the aesthetic appearance of the wall block 10. The center of the wall block 10 is hollow to reduce the overall weight of the block 10, and for convenient handling and placement of the block 10 during construction of the retaining wall.

Figure 5:
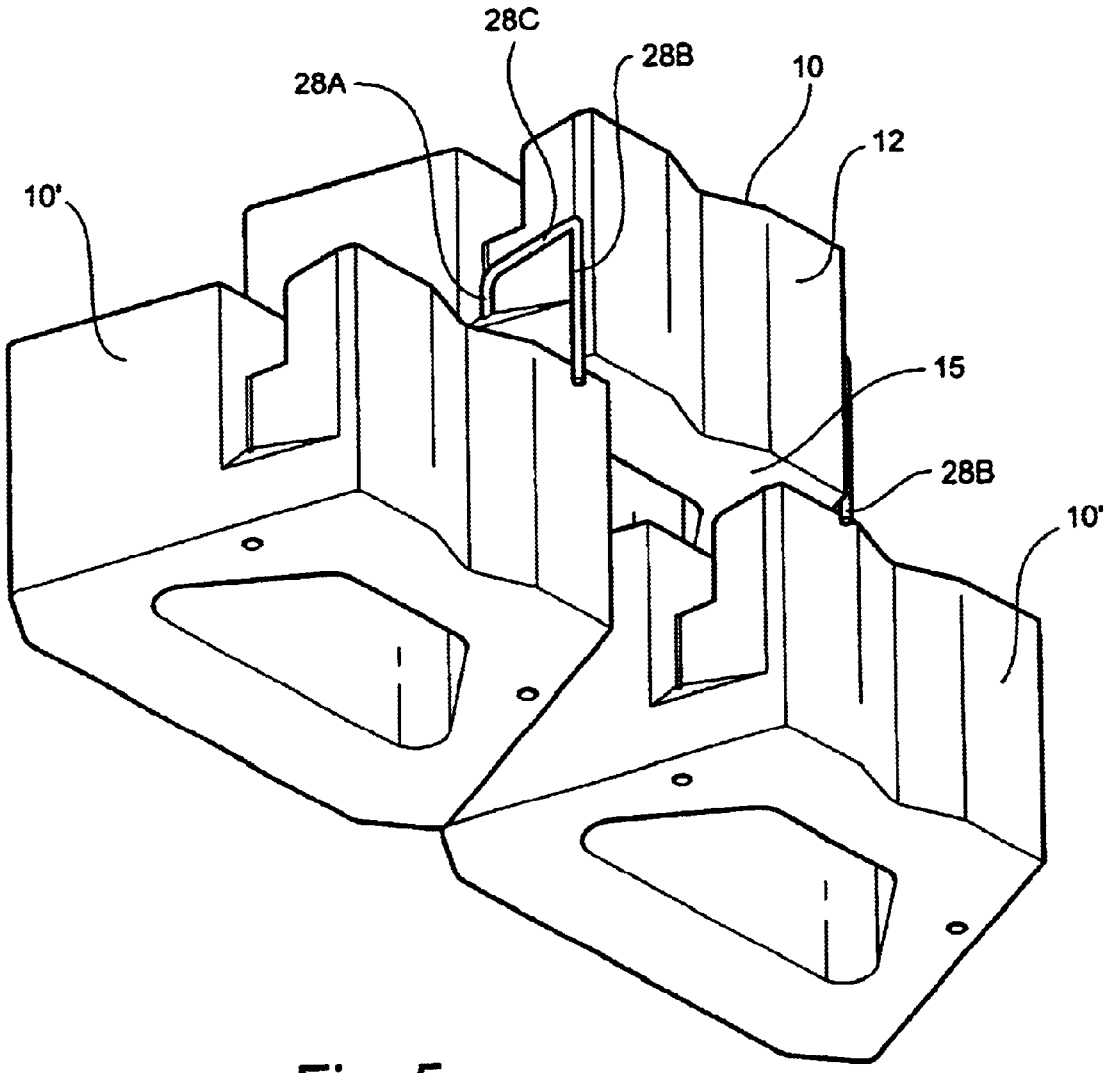
FIG. 5 is a bottom, rear perspective view of a number of wall blocks arranged in stacked courses.

The sides 16 and 17 of the wall block 10 define respective cutouts 21 and 22 each having a landing 23, 24, and an anchor hole 25, 26 formed with the landing 23, 24 and adapted for receiving a metal anchor pin 28. As best shown in FIG. 1, the anchor pin 28 has a connecting end 28A and an anchoring end 28B integrally joined by a setback spacer 28C. The connecting end 28A is into the anchor hole 25, 26 of the wall block 10. The anchoring end 28B extends outwardly from the bottom 15 of the wall block 10, as shown in FIG. 5, and engages one of the like blocks 10' in the lower course. The spacer 28C locates the anchoring end 28B a spaced distance from the rear 12 of the block 10 in order to anchor the block 10 in the retaining wall at a predetermined setback relative to like blocks 10' in the lower course. If a greater or lesser setback is desired, the anchor pin 28 may be exchanged with a similar pin having a longer or shorter setback spacer 28C. Preferably, the connecting end 28A and anchoring end 28B extend in parallel directions, and generally perpendicular to the setback spacer 28C. To facilitate placement of the anchor pin 28, the landings 23, 24 preferably slope downwardly from the anchor holes 25, 26 to respective sides 16, 17 of the block 10.

A recessed, setback control surface 31 is formed with the rear 12 of the block 10 and cooperates with an anchor pin of an upper course block to control setback of the upper course block when forming a radius in the retaining wall. After placement of adjacent lower course blocks at the desired radius, the upper course block is stacked such that the anchoring ends of the anchor pins engage the lower course blocks in respective areas of the setback control surfaces. The setback control surface 31 is suitably recessed in order to achieve a generally uniform and constant setback throughout the entire curve of the wall.

Figure 6:
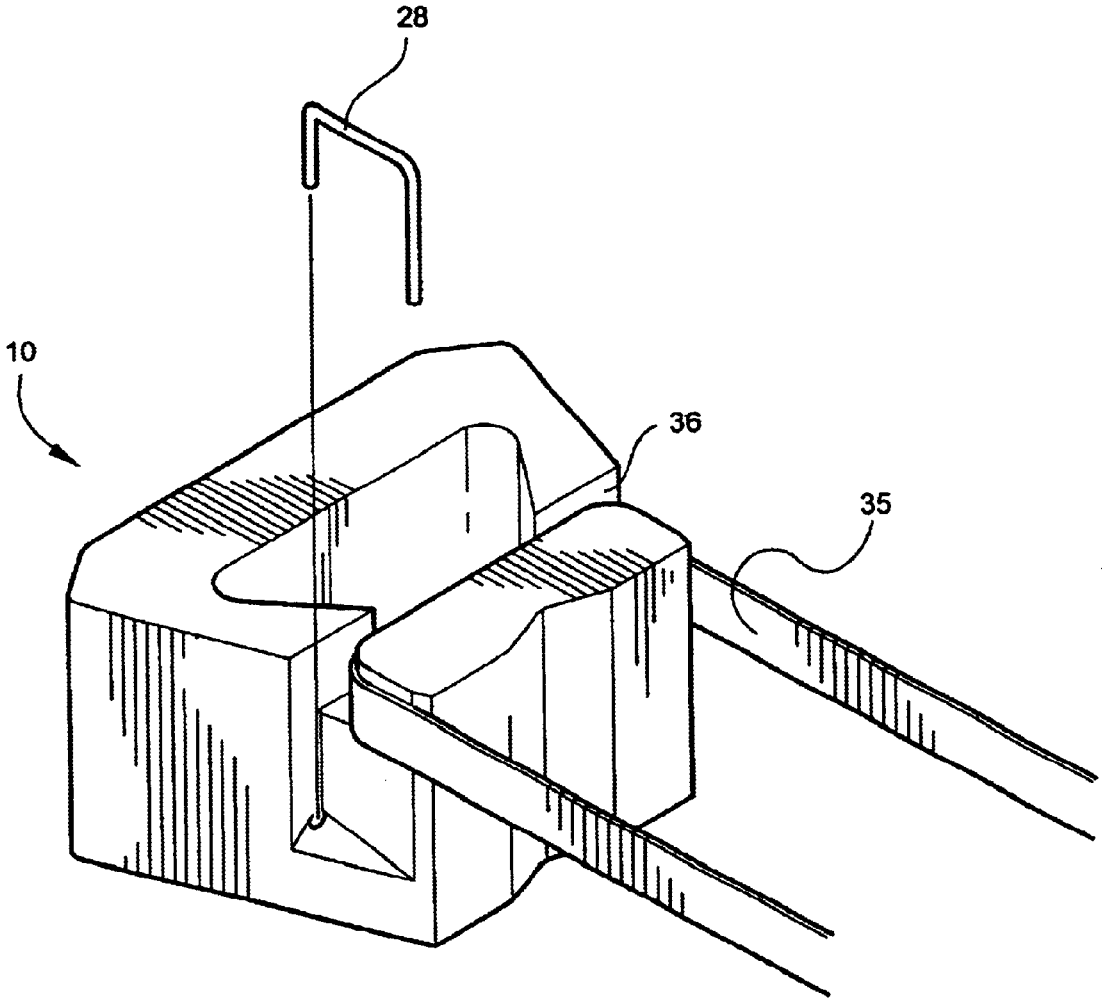
FIG. 6 is a top, rear perspective view of the wall block with a fabric anchor strap wrapped around the rear to further secure the block in the retaining wall.
Figure 7:
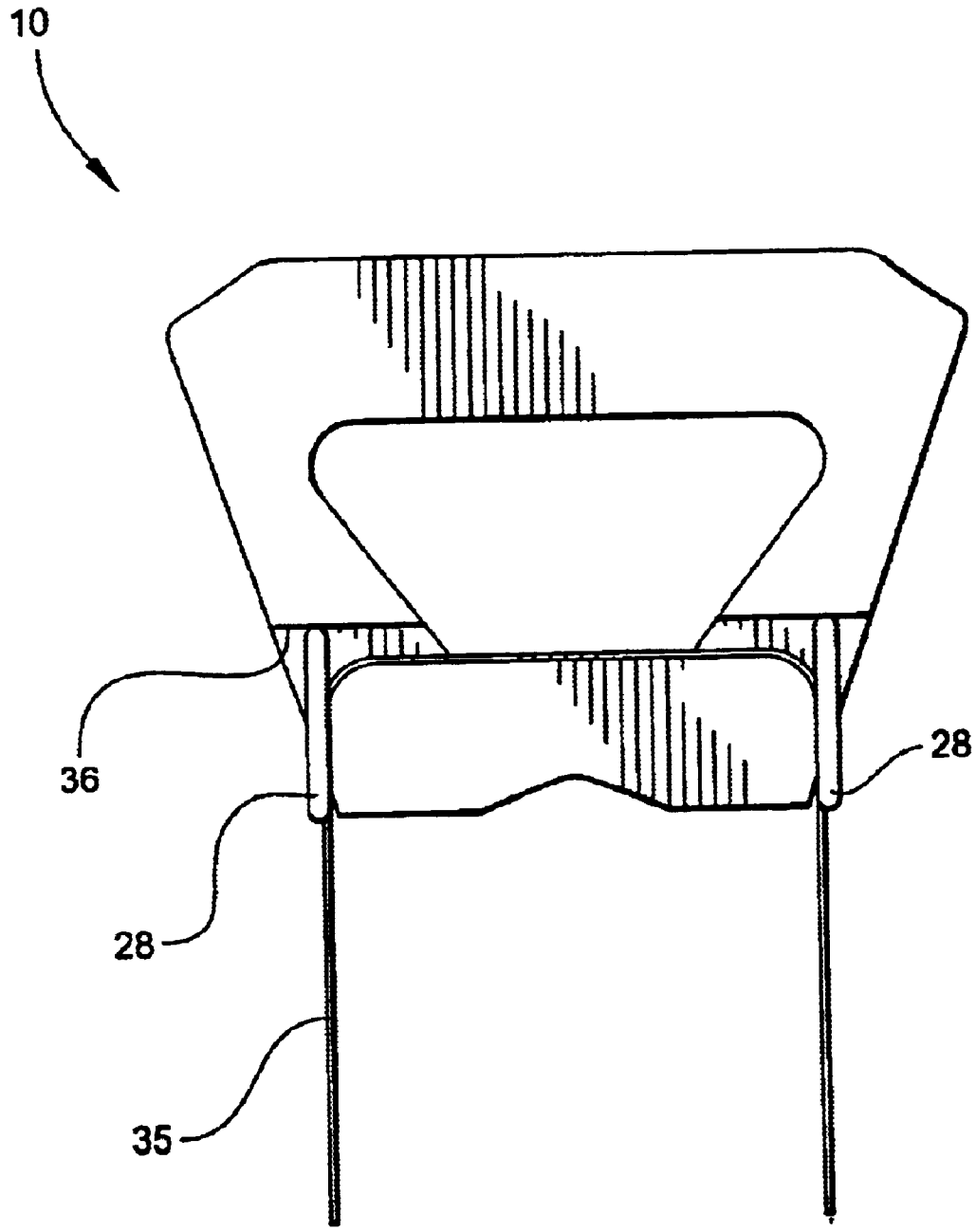
FIG. 7 is a top plan view of the wall block and anchor strap shown in FIG. 6.

FIGS. 6 and 7 show the wall block 10 with an anchor strap 35 positioned within a channel 36 formed with a top rear portion of the block 10. The anchor strap 35 extends rearwardly into the soil backfill to help stabilize the retaining wall. According to one embodiment, the anchor strap 35 is formed of polyester.

Figure 8:
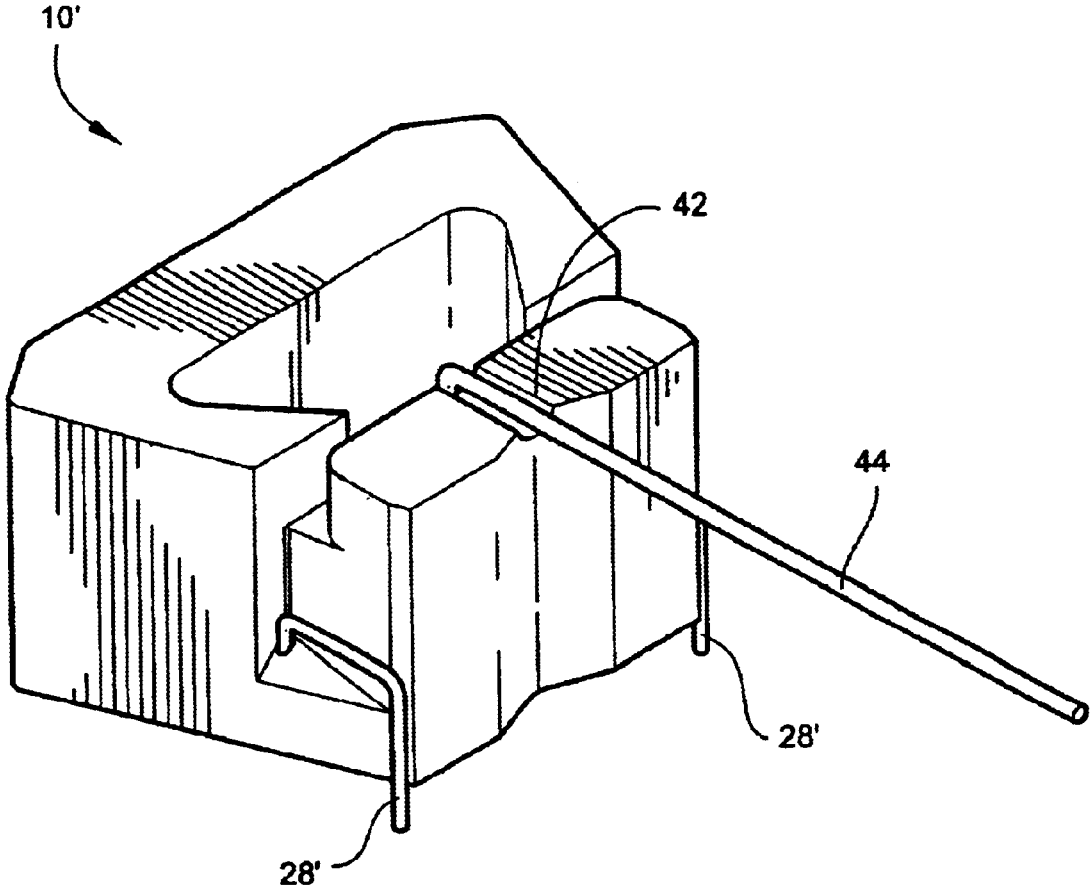
FIG. 8 is a perspective view of a wall block including anchor pins and a rearwardly extending tie-back bar.
Figure 9:
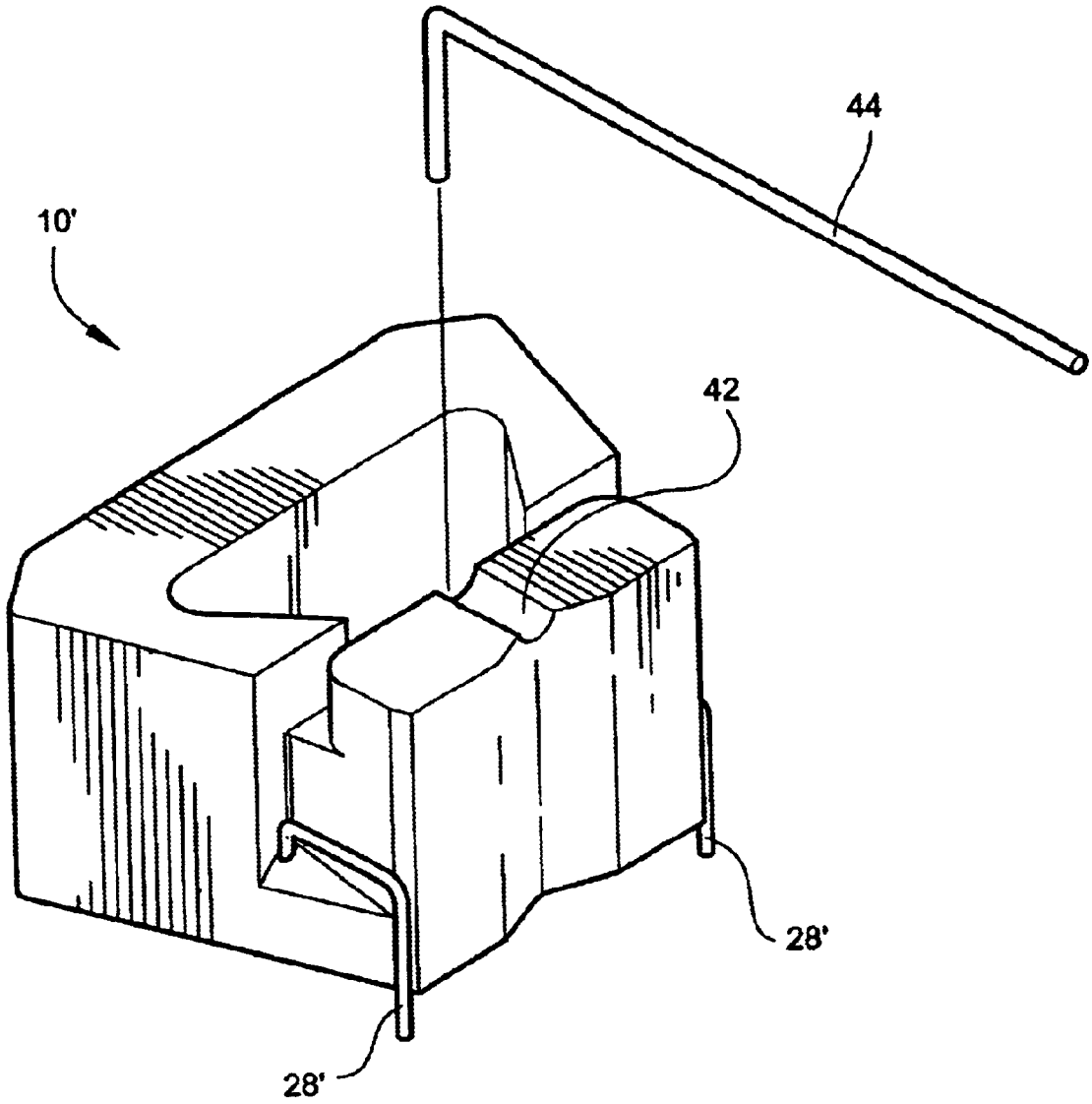
FIG. 9 is a perspective view of the wall block shown in FIG. 8 with the tie-back bar exploded away from the tie-back groove formed in the rear of the block.

FIGS. 8 and 9 illustrate a further embodiment of a wall block 10' according to present invention. Wall block 10' includes anchor pins 28', as previously described, and a rearwardly extending tie-back bar 41 adapted for securing the block 10' to the soil backfill behind the retaining wall (not shown). As demonstrated in FIG. 9, the tie-back bar 41 is generally L-shaped and fits within a groove 42 formed in the rear of the block 10'.

Preferably, after assembling the wall blocks 10, 10', as described above, a course of molded concrete wall caps (not shown) are placed over the top course of blocks to finish the retaining wall. A geogrid mat or other tie-back may also be used to further anchor the blocks to the soil behind the wall.

A wall block is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

We claim:

1. A modular wall block adapted for being assembled together with a number of other blocks in stacked courses to form a retaining wall, said wall block comprising:

(a) a front and rear, top and bottom, and opposing sides; and (b) a generally J-shaped anchor having a connecting end and an anchoring end joined by a setback spacer, said connecting end extending beyond the setback spacer in a direction parallel to said anchoring end adapted for being inserted into said wall block to secure said anchor to said block, and said anchoring end extending outwardly from one of the top and bottom of said wall block to engage one of the other blocks in an upper or lower course, said spacer locating said anchoring end a spaced distance from said connecting end to secure said block in the retaining end a spaced distance from said connecting end to secure said block in the retaining wall relative to the other blocks in the upper or lower course.

2. A wall block according to claim 1, wherein the connecting end of said anchor extends perpendicular to the setback spacer.

3. A wall block according to claim 1, wherein the anchoring end of said anchor extends perpendicular to the setback spacer.

4. A wall block according to claim 1, wherein the connecting end and the anchoring end of said anchor extend generally parallel to each other.

5. A wall block according to claim 1, wherein the anchoring end of said anchor is greater than 25% longer than the connecting end.

6. A wall block according to claim 1, wherein each of the opposing sides of said block defines a cutout and landing, and an anchor hole formed with said landing,and adapted for receiving the connecting end of said anchor.

7. A wall block according to claim 6, wherein said landing slopes from the anchor hole towards the side of said block.

8. A wall block according to claim 1, and comprising a setback control surface formed with the rear of said block and cooperating with an anchor of an upper or lower other block to control setback of the other block when forming a radius in the retaining wall.

9. A wall block according to claim 1, wherein the front, rear, and opposing sides define a hollow center portion of said wall block.

10. A wall block according to claim 1, wherein the sides of said wall block taper inwardly from the front to the rear.

11. A modular wall block adapted for being assembled together with a number of other blocks in stacked courses to form a retaining wall, said wall block comprising:

(a) a front and rear, top and bottom, and opposing sides; and (b) a generally J-shaped anchor pin having a connecting end and an anchoring end integrally joined by a straight setback spacer, said connecting end extending outwardly at an angle to said setback spacer and adapted for being inserted into said wall block to secure said anchor pin to said block, and said connecting end and said anchoring end extending generally parallel to each other beyond said setback spacer, and said anchoring end extending outwardly from one of the top and bottom of said wall block to engage one of the number of other blocks in an upper or lower course, said spacer locating said anchoring end a spaced distance from the rear of said block, whereby said anchor pin secures said block in the retaining wall at a predetermined setback relative to the other blocks in the upper or lower course.

12. A retaining wall constructed of a number of modular wall blocks assembled in stacked courses, each of said wall blocks comprising:

(a) a front and rear, top and bottom, and opposing sides; and (b) a generally J-shaped anchor having a connecting end and an anchoring end joined by a straight setback spacer, said connecting end extending perpendicularly outward from said setback spacer and adapted for being inserted into said wall block to secure said anchor to said block, and said connecting end and said anchoring end extending generally parallel to each other beyond said setback spacer, and said anchoring end extending outwardly from one of the top and bottom of said wall block to engage one of the number of other blocks in an upper or lower course, said spacer locating said anchoring end a spaced distance from said connecting end to secure said block in the retaining wall relative to the other blocks in the upper or lower course.

13. A retaining wall according to claim 12, wherein the anchoring end of said anchor is greater than 25% longer than the connecting end.

14. A retaining wall according to claim 12, wherein each of the opposing sides of said block defines a cutout and landing, and an anchor hole formed with said landing and adapted for receiving the connecting end of said anchor.

15. A retaining wall according to claim 14, wherein said landing slopes from the anchor hole towards the side of said block.

16. A retaining wall according to claim 12, and comprising a setback control surface formed with the rear of said block and cooperating with an anchor of an upper or lower other block to control setback of the other block when forming a radius in the retaining wall.

17. A retaining wall according to claim 12, wherein the front, rear, and opposing sides define a hollow center portion of said wall block.

18. A retaining wall according to claim 12, wherein the sides of said wall block taper inwardly from the front to the rear.

* * * * *